US006640545B2

(12) United States Patent
Ruck et al.

(10) Patent No.: US 6,640,545 B2
(45) Date of Patent: Nov. 4, 2003

(54) BURNER WITH HIGH FLAME STABILITY

(75) Inventors: Thomas Ruck, Rekingen (CH); Hans Peter Knoepfel, Dottikon (CH)

(73) Assignee: Alstom Ltd., Baden (CH)

( * ) Notice: Subject to any disclaimer, the term of this patent is extended or adjusted under 35 U.S.C. 154(b) by 0 days.

(21) Appl. No.: 10/003,230

(22) Filed: Dec. 6, 2001

(65) Prior Publication Data

US 2002/0172905 A1 Nov. 21, 2002

(30) Foreign Application Priority Data

Dec. 22, 2000 (DE) ..... 100 64 259

(51) Int. Cl.[7] ..... F02C 1/00
(52) U.S. Cl. ..... 60/737; 60/750
(58) Field of Search ..... 60/748, 750, 737, 60/738; 431/350, 9, 11, 243

(56) References Cited

U.S. PATENT DOCUMENTS

| | | | | | |
|---|---|---|---|---|---|
| 5,339,630 | A | * | 8/1994 | Pettit | 60/303 |
| 5,954,490 | A | * | 9/1999 | Knopfel et al. | 431/115 |
| 6,019,596 | A | * | 2/2000 | Knopfel et al. | 431/350 |
| 6,106,278 | A | * | 8/2000 | Andersson et al. | 431/243 |
| 6,485,294 | B2 | * | 11/2002 | Riepenhoff et al. | 431/347 |

FOREIGN PATENT DOCUMENTS

| | | | |
|---|---|---|---|
| DE | 4412365 | A1 | 10/1995 |
| EP | 0321809 | B1 | 5/1991 |
| EP | 0687854 | A1 | 12/1995 |
| EP | 0780629 | A2 | 6/1997 |
| EP | 0908671 | A1 | 4/1999 |
| EP | 0945677 | A2 | 9/1999 |
| WO | 93/17279 | | 9/1993 |

* cited by examiner

*Primary Examiner*—Ehud Gartenberg
(74) *Attorney, Agent, or Firm*—Burns, Doane, Swecker & Mathis, L.L.P.

(57) ABSTRACT

The invention relates to a premix burner with high flame stability for use in a heat producer, preferably in the combustion chamber of a gas turbine. Modern lean operated premix burners make possible very low pollutant emissions, but sometimes operate very close to the extinction limit. To increase the stability of the lean premix combustion by increasing the distance between the flame temperature and the extinction limit temperature, it is proposed according to the invention to arrange a downstream combustion gas mixing section (300) for the burner, which mixing section (300) projects at least partially into the combustion chamber (50) and enables combustion gases from the combustion chamber (50) access to the fuel/air mixture (144) by means of combustion gas inlet openings (311). The added combustion gases (145) are mixed with the fuel/air mixture (144), and in this manner increase its temperature. This increase in temperature results in a significant increase in the flame speed, as a consequence of which the extent of the flame front (123) and the extinction limit temperature of the burner decrease.

19 Claims, 10 Drawing Sheets

BURNER WITH HIGH FLAME STABILITY

FIELD OF THE INVENTION

The invention describes a burner for a heat producer according to the preamble of claim 1.

BACKGROUND OF THE INVENTION

Premix burners are known from EP 0 321 809, EP 0 780 629, WO 9317279, as well as EP 0 945 677; in them, a combustion air stream is introduced tangentially into the interior of a burner by means of a swirl producer, and is mixed with fuel. At the burner outlet, the vortex flow which arises bursts open at a sudden change of cross section, with the initiation of a back-flow zone which serves to stabilize a flame in the operation of the burner.

Although such burners make possible an operation with very low pollutant emissions, they often operate dangerously near to the extinction limit of the flame. Flame temperatures usually obtained with the lean premix flames of such burners are about 1,700–1,750 K. The extinction limit of the flame is given as about 1,650 K. This value is comparatively high. This is based on the low fuel ratio in the fuel-air mixture. This reduces the flame speed, which in turn results in a flame front which is widely expanded spatially and is hence unstable.

A stronger enrichment of the mixture would, however, drive the pollutant emissions higher and would negate the value of the use of lean premix burners.

SUMMARY OF THE INVENTION

The present invention has as its object to improve the stability of the lean premix combustion of modern burners of the kind mentioned at the beginning, as particularly used in the combustors of gas turbines, in that the distance between the flame temperature and the extinction limit temperature is enlarged. Here an essential raising of the combustion temperature is to be avoided in order to furthermore ensure a low-pollutant operation.

This is attained according to the invention in that the burner has a combustion gas mixing section at a downstream end, the said combustion gas mixing section partially projecting into a combustion space, and having combustion gas inlet apertures into the combustion space upstream of its mouth, through which combustion gas inlet apertures an amount of combustion gas flows from the combustion space into the combustion gas mixing section.

The invention makes use of the knowledge that an increase of the temperature of the fresh gas—and thus of the fuel-air mixture—results in an increase of the flame speed. In the relevant region, an increase of the fresh gas temperature by 300 K leads to about a doubling of the flame speed. As a result, the extent of the flame front is reduced, and the extinction temperature of the burner falls.

The core of the invention is thus an increase of the temperature of the fuel-air mixture in the process of combustion. A preheating of the combustion air is actually no longer realizable, precisely in gas turbine applications. Therefore, according to the invention, a combustion gas mixing section projecting into the combustion zone is used, in which on the one hand the premixed fuel/air mixture flows in as fresh gas, but in which on the other hand hot combustion gases flow in from the combustion space into the combustion gas mixing section in an upstream region of the mixing section, mix with the fresh gas in the mixing section, and thus raise the temperature of the combustion zone forming downstream of the combustion gas mixing section.

As described above, the extinction limit temperature of the flame is thereby lowered, and thus the flame stability is improved at the same combustion temperature.

It is indeed in the foreground that raising the mixture temperature increases the combustion temperature and thus the formation of nitrogen oxides; however, it should not remain unconsidered that the fuel air mixture is mixed with inert combustion gas. Hence the middle flame temperature is raised, but the power density and the temperature rise decrease, which compensates for the effect on the pollutant formation and particularly the formation of nitrogen oxides. The effects combine favorably when the mass flow of the admixed combustion gases is between 5% and 60% of the air mass flow supplied.

The admixture of combustion gases can be supported by suitable constructional measures. In particular, the axial flow cross section of the mixing section can be shaped so that at the place at which the combustion gas inlet apertures are located, a reduced pressure predominates relative to the combustion space. This can be attained, for example, in that the axial flow cross section has a sudden cross section widening, at which an eddy with a reduced pressure forms. The combustion gas inlet apertures are in this case arranged immediately downstream of the sudden change in cross section. In operation, the combustion gases are sucked into the eddy. Care has to be taken here that the cross section ratio of the flow sections upstream and downstream of the change in cross section is not too large, so that the swirl flow produced in the burner is maintained as far as the mouth of the mixing section in the combustion space, which is essential for the function of the burner mentioned in the preamble of the claims. A cross-sectional surface ratio in the region of 1.05–2.5 ensures good operating performance.

A further possibility of affecting the pressure ratios toward a strengthened mixing-in of combustion gases, by means of the pressure ratios in the combustion gas mixing section, is represented by a diffusor-like formation of the mixing section downstream of the combustion gas inlet apertures; also, a convergent-divergent course of the mixing section, in which the combustion gas inlet apertures are situated in the region of the narrowest flow cross section, is possible. The diffusor half-angle of the divergent portion of the combustion gas mixing section is in these cases to be in the region of 3° to 10°, preferably 5°.

The invention is based on premix burners which are well known and familiar to the person skilled in the art from the prior art cited at the beginning. The invention can be directly combined with all the familiar kinds of swirl producers and burners disclosed in the documents cited there and developed from these documents and known per se to the person skilled in the art, and as only incompletely reflected in the preferred variants given in the dependent claims, among the multiplicity of possible embodiments.

The wall of the combustion gas mixing section is situated in operation in a strong hot gas exposure. In particular, when using conventional materials, it is advantageously embodied as cooled. A film cooling is preferred for reasons of cooling efficiency.

On the other hand, it is possible to mechanically decouple the combustion gas mixing section from the rest of the burner components, that is, from the swirl producer and/or a mixing tube which may possibly follow the swirl producer. This advantageously facilitates the use of materials whose expansion coefficients and thermal resistance are greatly different from those of the burner. Since the combustion gas mixing section furthermore has no appreciable mechanical loads to carry, it can advantageously be completely embodied in ceramic. In this case, cooling can be omitted in spite of the hot gas exposure of the mixing section, or the cooling can be a closed embodiment. Abstaining in this manner from blowing cooling medium into the region of the flame immediately confers advantages which are recognized by a person skilled in the art.

BRIEF DESCRIPTION OF THE DRAWINGS

Further features, advantages and details of the invention will be explained hereinbelow with reference to the accompanying drawings. Only elements of importance for the invention are shown. The same or corresponding elements are given the same reference numerals.

DETAILED DESCRIPTION OF THE INVENTION

Figure 1:
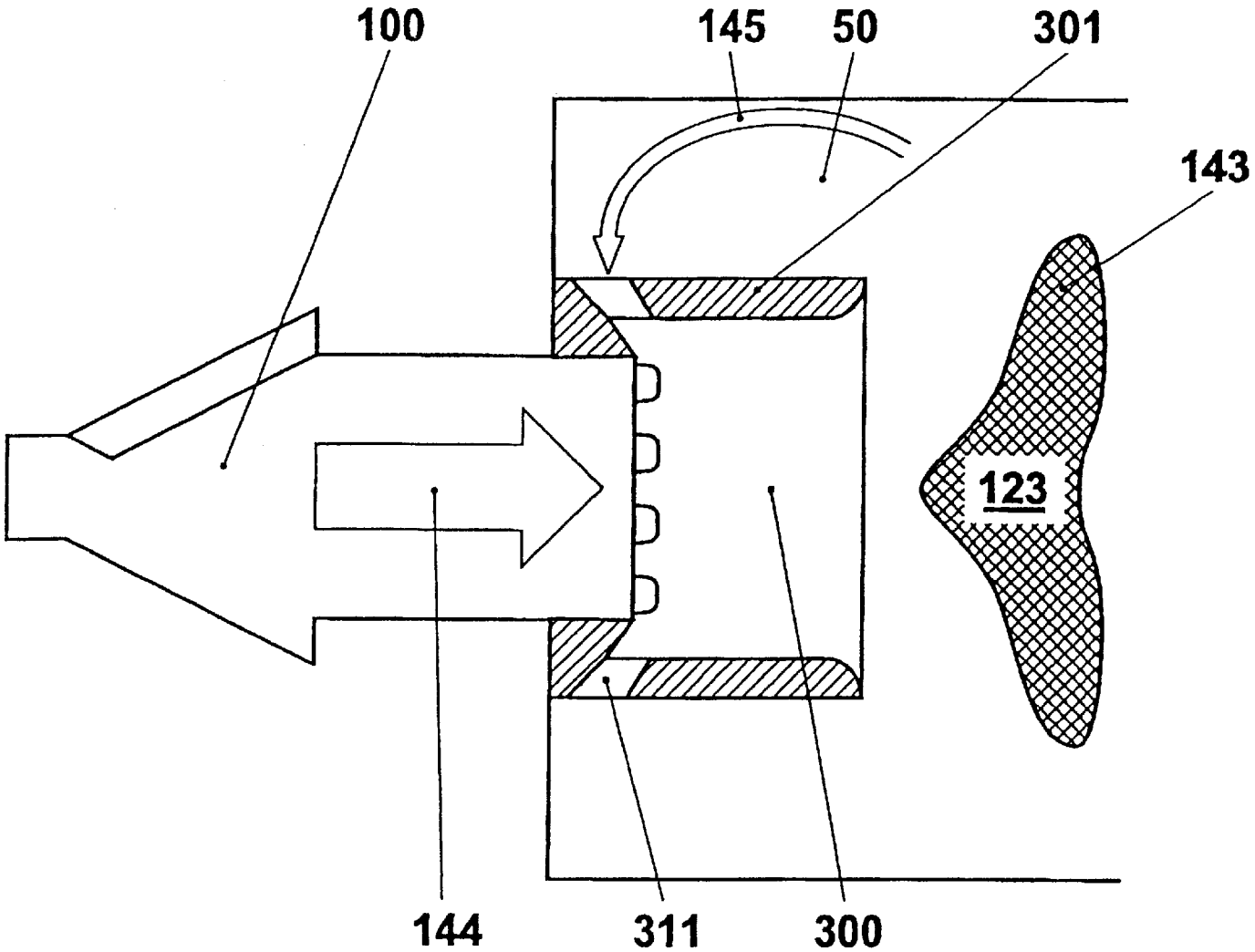
FIG.1 is a cross sectional view of the burner according to a preferred embodiment of the present invention.
Figure 2:
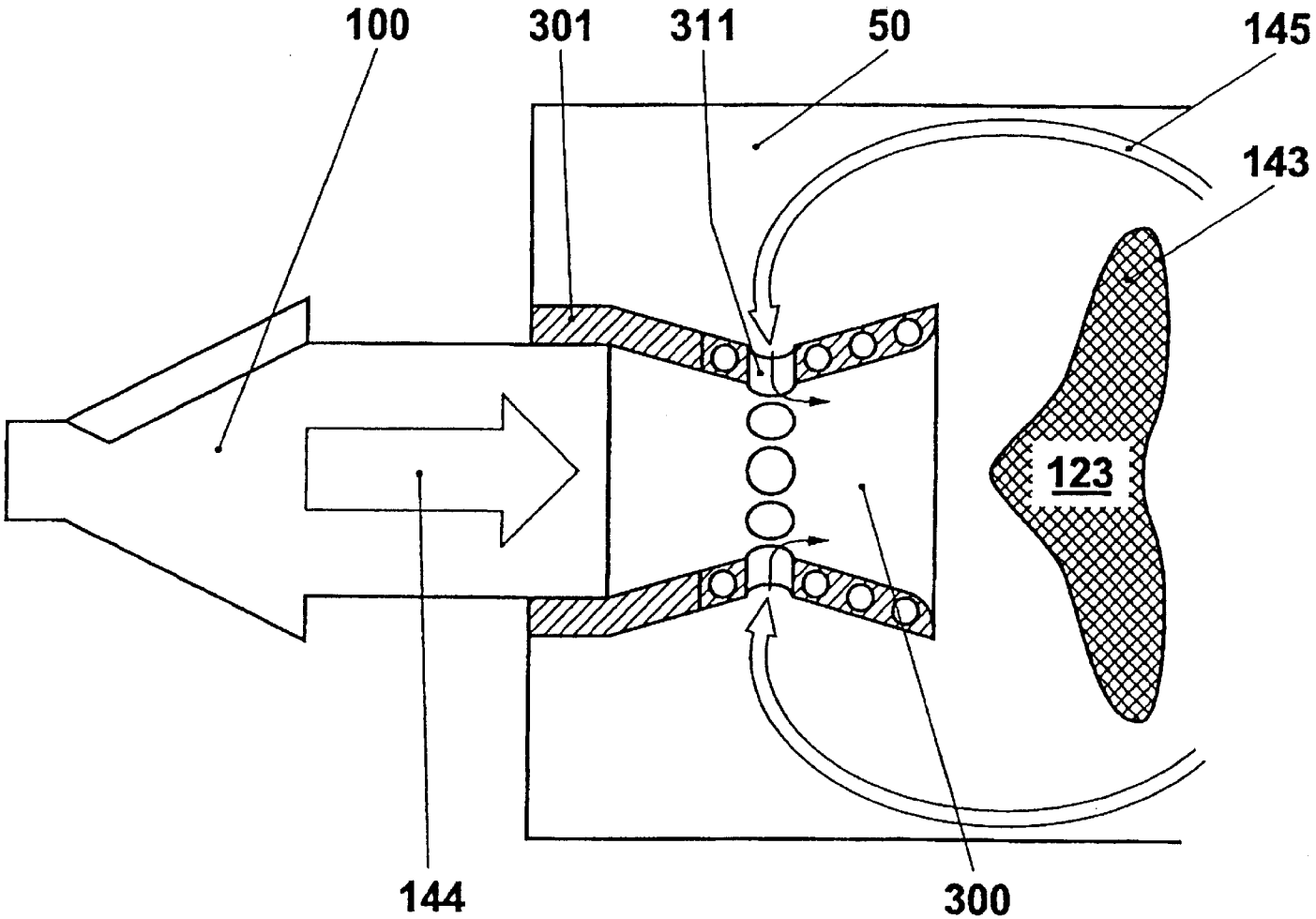
FIG. 2 is a cross sectional view of the burner according to an alternative embodiment of the present invention.

FIGS. 1 and 2 reproduce, very schematically, the essence of the invention. Initially the swirl producer 100 is effective; its possibilities of embodiment are discussed in further detail in the following FIGS. 3–5. As is shown there, a premix burner, known per se, can be concerned for this swirl producer 100, as is described, among other things, in the publications cited in this explanation. These burners, cited by way of example, are all based on a common principle. They have an axially extending, at least approximately rotationally symmetrical cavity 122, into which combustion air flows through inlet slots 121 running preferably parallel to the longitudinal axis. The combustion air receives a strong tangential speed component from the tangential alignment of these more or less slot-shaped inlet apertures 121, resulting in a swirl flow through the said internal space (122) from the reciprocal action of the said tangential component with the axial components directed toward the burner mouth. The enrichment of the combustion air with fuel takes place alternatively or complementarily through means (1111) on the housing jacket close to the combustion air inlet slots (121) and/or by means of central supply means (113) in the burner axis **(100*a*)**.

It is furthermore common to these burners that the flow cross section constantly widens in the direction to the burner outlet, in order to maintain approximately constant flow conditions with the increasing mass flow.

Al-though burners referred to in the present document are based on the stated uniform principle, the invention is not to be restricted to this particular category of swirl burners, but is to include any kind of premix burners whose flame stability is to be increased at constant low pollutant emissions.

According to the invention a mixing section (300) projecting into the combustion chamber (50) in extension of the burner axis adjoins the burner mouth. This can take place in any suitable manner. Depending on the specific conditions of the case of application, a range of possibilities will be accessible to the person skilled in the art. Thus the mixing section (300) can be directly connected to the swirl producer (100), for example by means of a flange connection. Alternatively, the swirl producer (100) and mixing section (300) can be indirectly connected, with the interposition of the combustion chamber wall. Hot combustion gases from the combustion chamber (50) are admixed to the premixed fuel/air mixture in this mixing section (300). For this purpose, the mixing section (300) forms a region of relatively reduced pressure at its upstream end, equipped with a number of passage channels (311) for the combustion gases from the combustion chamber (50). The relative reduced pressure is produced by a corresponding shape of the mixing section (300).

According to a preferred embodiment, shown in FIG. 1, the mixing region (300) has a sudden widening of cross section with respect to the swirl zone (100). A boundary layer detachment of the outer flow takes place on flowing through this region, with the formation of a region of greatly decelerated flow, the eddy, on the back side of the outer flow. It has been found to be advantageous for the ratio of cross-sectional surfaces to be 1.05–2.5.

According to an alternative embodiment, shown in FIG. 2, the internal contour of the mixing section (300) takes a convergent-divergent course, the combustion gas inlet apertures (311) being arranged distributed over the periphery in its narrowest cross section. In order to ensure an undisturbed flow path, the diffusor half angle takes a value of 5°. The combustion gases mix very homogeneously with the fuel/air mixture within the mixing section (300), which inevitably leads to a significant rise of the mixture temperature. Precise-ly this temperature rise increases the flame front speed and thus reduces the extinction limit temperature, clearly improving the flame stability at the same, or only slightly higher, combustion temperature.

The combustion gas passage channels (311) pass through the jacket housing (301) of the mixing section (300) either radially or with a component in the flow direction. This means that the longitudinal axes of these apertures (311) run perpendicularly or at an acute angle to the burner axis **100*a***. The range of variation of their cross sectional shapes is many and diverse, and ranges from being circular to being an annular gap. They can have a parallel or conically widening internal contour.

Figure 3:
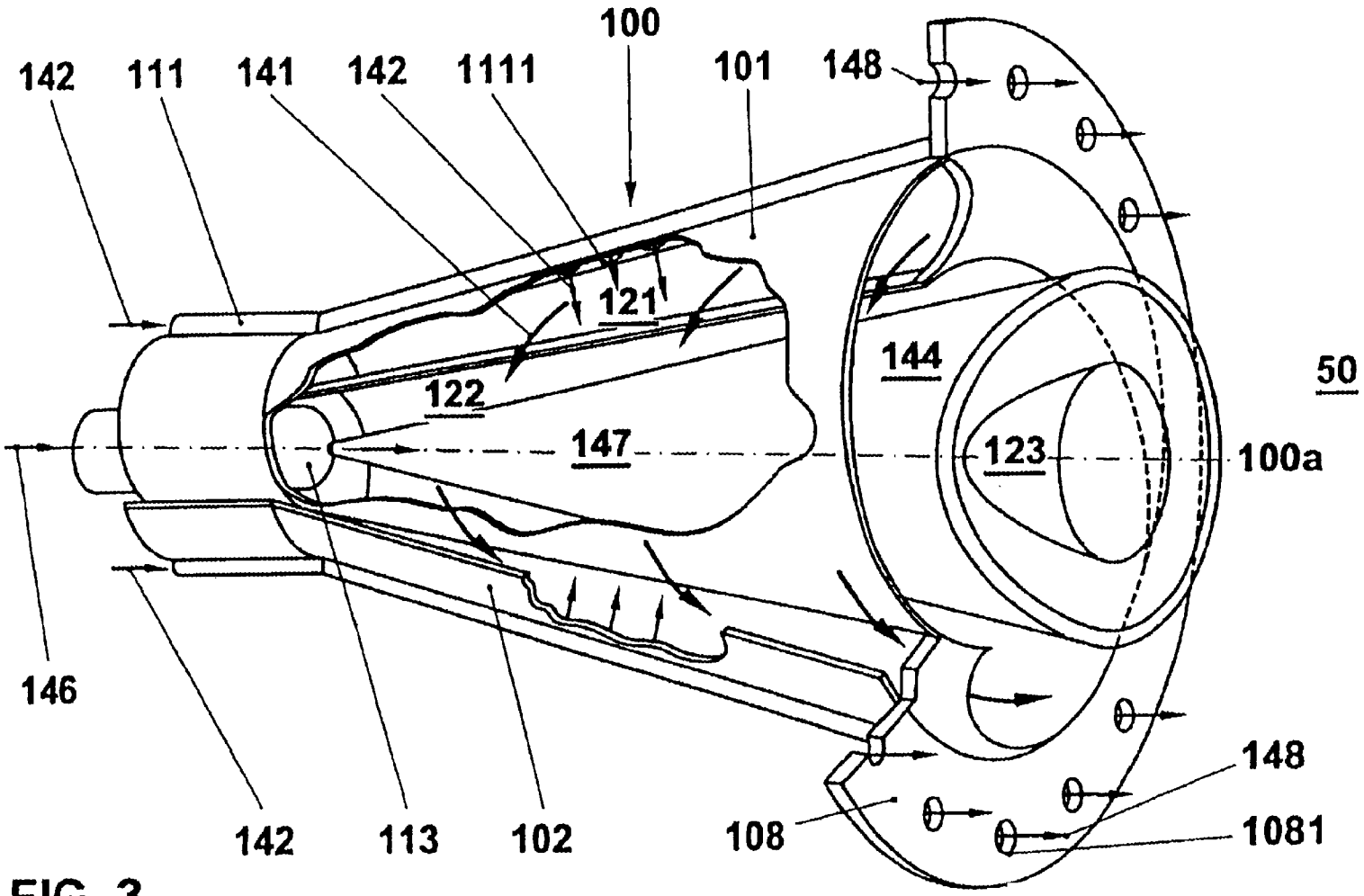
FIG. 3 PRIOR ART
FIG. 3 is a perspective view, with portions taken away, of a prior art burner.

The burner as characterized in the preamble of the claims is familiar to the person skilled in the art in different constitutions which can differ in specific embodiment from the burner shown in FIG. 3, which substantially consists of a conical swirl producer. Nevertheless, all these burners are constructed according to a common principle: they have a swirl producer in the form of a hollow body, with a longitudinal extent which includes a swirl producer interior. The swirl producer furthermore has inlet slots extending in the direction of the swirl producer longitudinal axis, or inlet apertures arranged in the direction of the longitudinal axis, their throughflow cross section substantially predetermining a tangential flow direction. Combustion air flows through these inlet apertures into the swirl producer interior with a strong tangential speed component, and forms there a swirl flow with a certain axial component directed toward the burner mouth in the combustion space. The axial flow cross section of the swirl producer interior is advantageously widened out here toward the burner mouth, at least in the region of the air inlet apertures. This constitution is favorable in order to attain a constant swirl number of the swirl flow with a combustion air mass flow which increases in the direction of the swirl producer axis. These burners furthermore have means to introduce fuel into the combustion air flow, to mix as homogeneously as possible with the swirled combustion air in a mixing zone, for example a mixing tube, to be optionally arranged downstream of the swirl producer. A sudden cross section change of the axial flow cross section is present at the outlet from the burner into the combustion space. A bursting open of the swirl flow occurs here, with the formation of a central backflow zone which, as described in detail herein-above, is usable for the stabilization of a lean premix flame.

Figure 7:
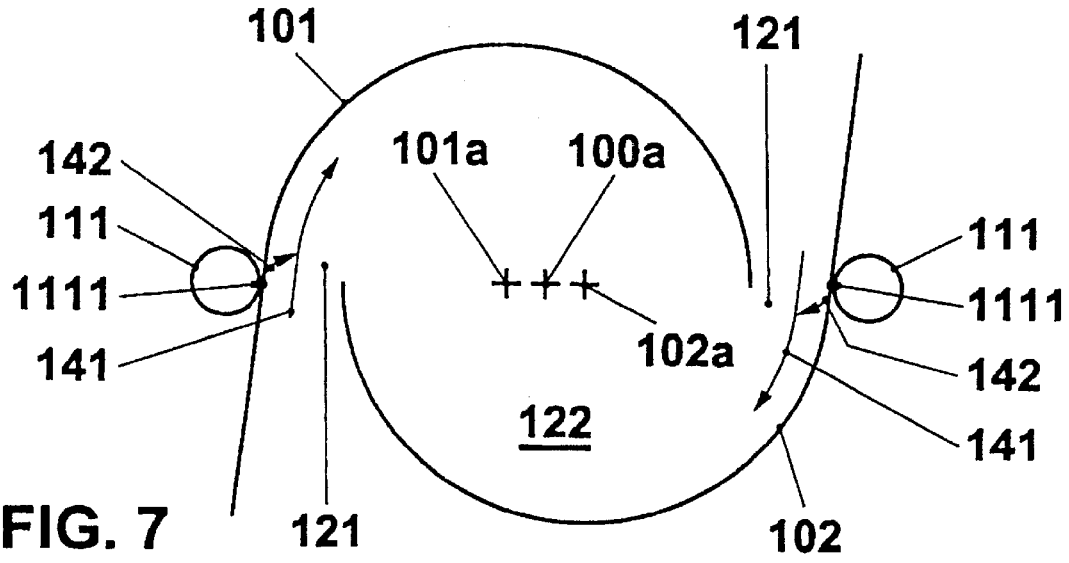
FIG. 7 is a cross sectional view of a two-shell swirl producer.
Figure 8:
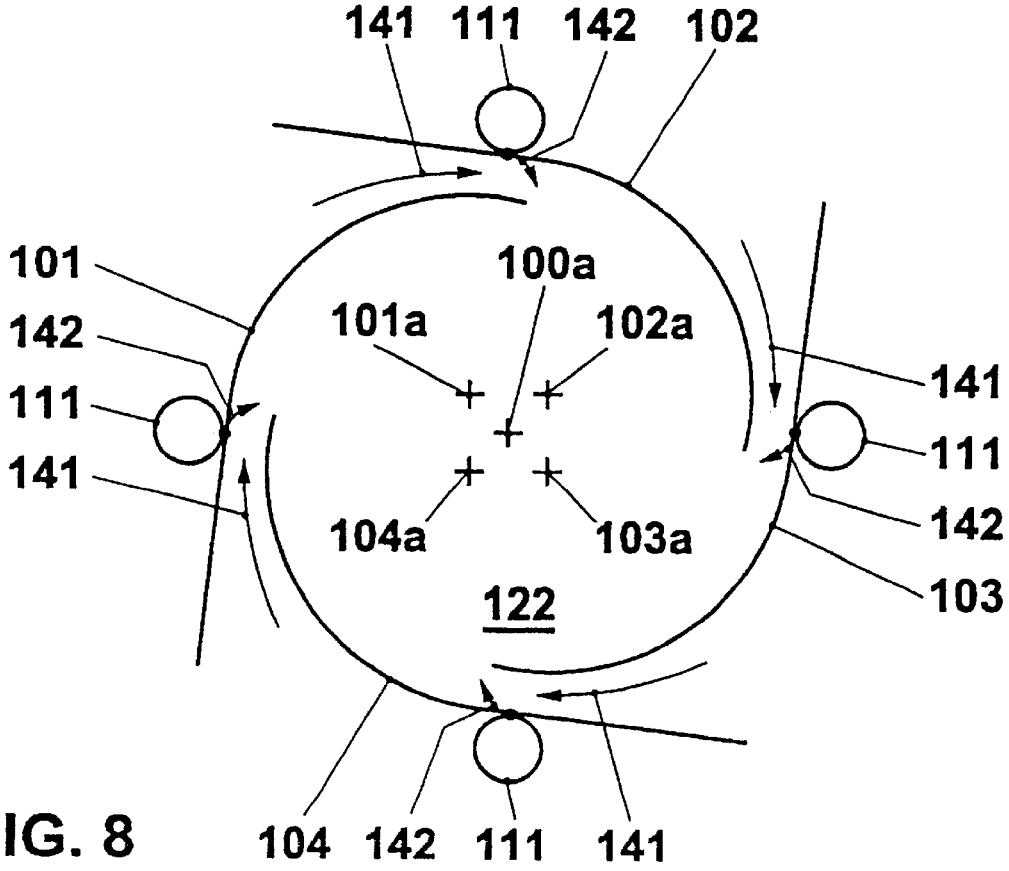
FIG. 8 is a cross sectional view of a four-shell swirl producer.

FIG. 3 shows a preferred embodiment of a premix burner characterized in the preamble of the claims, and as known per se from EP 0 321 809. The burner substantially consists of a swirl producer 100 for a combustion air flow, formed from two conical partial members 101, 102. It can be seen from the cross section shown in FIG. 7 that the partial members 101 and 102 are arranged with their axes 101*a* and 102*a* offset with respect to the burner axis 100*a* and also opposedly laterally. Because of this lateral offset of the partial members, tangential inlet slots 121 are constituted between the partial members. A combustion air flow 141 flows substantially tangentially into the interior 122 of the swirl producer 100 through the tangential inlet slots 121. Of course it is also possible to embody such a swirl producer 100 with another number of partial members; a completely analogous construction with, for example, four swirl producer partial members 101, 102, 103, and 104 is shown in FIG. 8, with the mutually offset axes 101*a*, 102*a*, 103*a*, 104*a* of the partial members. Referring again to FIG. 3, a swirl flow 144 is consequently formed within the swirl producer, with its axial flow component facing toward the downstream mouth of the swirl producer 100. The partial members 101, 102 border on the downstream end of the swirl producer 100 at a front plate 108. The front plate 108 usually forms the end wall of a combustion space 50, and is normally cooled. In the embodiment example, cooling air 148 flows through cooling bores 1081. The interior 122 of the swirl producer 100 has a substantially frustroconical shape, widening from an upstream to a downstream end of the swirl producer (100) or burner. The axial flow cross section thus formed has at its downstream end, at the opening into the combustion space 50, a sudden widening of the cross section. Due to the sudden change in cross section, a bursting open of the vortex flow 144 and the formation of a backflow zone 123 occur in the region of the burner mouth. An amount of fuel is supplied in a suitable manner to the combustion air flow in the swirl producer 100. In the embodiment example, fuel ducts 111 are arranged along the partial members 101, 102 in the axial direction of the swirl producer 100 in the region of the tangential inlet slots 121. Rows of fuel outlet bores 1111 can be seen in the embodiment example. An amount of fuel 142 is fed in by means of the fuel ducts 111 and flows through the fuel outlet openings 1111 into the interior 122 of the swirl producer 100. This kind of fuel admixture frequently and preferably finds application with gaseous fuels. Furthermore, a fuel 146 can be introduced additionally, or as an alternative to the amount of fuel 142, into the swirl producer interior 122 by means of a central fuel nozzle 113; in the example in FIG. 3, this is a liquid fuel, which forms a spray cone 147 in the swirl producer interior. Intensive mixing of the amount of fuel 142 with the combustion air 141 flowing in tangentially occurs in the interior of the swirl producer 100. A very homogeneous mixture of air and fuel is present in the swirl flow 144 at the outlet from the burner into the combustion space 50. A flame from the premixed fuel/air mixture can be stabilized in the region of the backflow zone 123. Because of the good premixing of air and fuel, this flame can be operated with a quite high air excess—as a rule, air numbers of two and more are found at the burner itself—while avoiding stoichiometric zones with the formation of hot spots. Because of these comparatively cool combustion temperatures, very low nitrogen oxide emissions can be attained with such burners without expensive exhaust gas treatment. Because of the good premixing of the fuel with the combustion air and good flame stabilization by means of the backflow zone, a good burnup is furthermore attained, in spite of the low combustion temperatures, and thereby also low emissions of partially combusted and uncombusted materials, thus particularly carbon monoxide and uncombusted hydrocarbons, but also other undesired organic compounds, are attained. Furthermore, the purely aerodynamic flame stabilization by the bursting open of the swirl flow 144 ("vortex breakdown") is found to be advantageous. By dispensing with mechanical flame holders, no components which are mechanical per se come into contact with the flame. The feared failure of mechanical flame holders due to overheating, with the possible result of severe damage to machine sets, is thus excluded. Further the flame loses no heat to cold walls, other than by radiation. This additionally contributes to comparative moderation of the flame temperature and thus lower nitrogen oxide emissions and good combustion stability.

Figure 4:
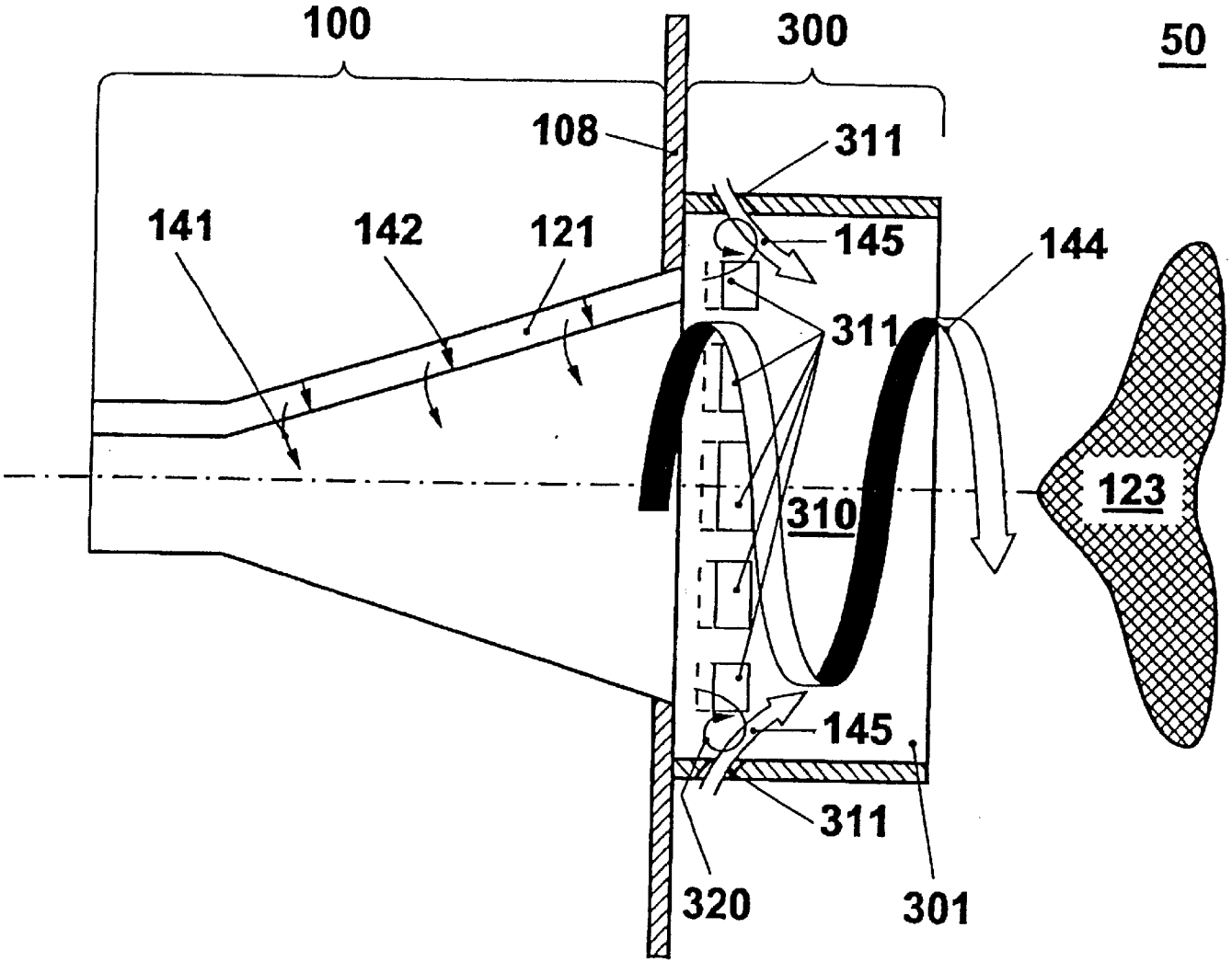
FIG. 4 is a cross sectional view of the burner according to the preferred embodiment of the present invention.

According to the invention, combustion gases are admixed with the premixed fuel/air mixture in the swirl flow 144. As depicted in FIG. 4 in more detail than in FIG. 1, a combustion gas mixing section 300 is arranged down-stream of the swirl producer 100 and projects into the combustion chamber 50. At the transition from the swirl producer (100) to the combustion gas mixing section (300), the configuration has a small, sudden cross section widening. This is sufficient to permit an eddy to arise. On the other hand, the cross section widening is also small enough for the swirl flow 144 to continue to exist, largely undisturbed and to be extended further, transversely through the interior 310 of the combustion gas mixing section 300. Combustion gas passage channels 311 are arranged in the wall 301 of the mixing section 300. These are advantageously arranged in a region in which the eddy 320 is effective, with the resulting reduced pressure. A combustion gas amount 145 is hereby sucked into the mixing section 300. These combustion gases 145 can mix very homogeneously with the swirled fuel/air mixture within the combustion gas mixing section 300. The temperature of the swirl flow 144 is significantly raised by the mixing with the hot combustion gases 145. As already explained at another place, this rise in temperature raises the flame front speed and thus lowers the extinction limit temperature. At equal or only marginally higher combustion temperature, the flame stability is thus clearly improved.

Burners according to the preamble of the claims are likewise known from WO 93/17279 and EP 0 945 677, and have cylindrical swirl producers with tangential combustion air inlets. In this connection it is also known to arrange a compression member (105), tapering toward the burner mouth, within a cylindrical swirl producer. The favorable criteria given above for the axial throughflow cross section of the swirl producer, namely that the axial throughflow cross section increases in the axial throughflow direction, can furthermore be fulfilled by such a swirl producer interior member (105).

Figure 5:
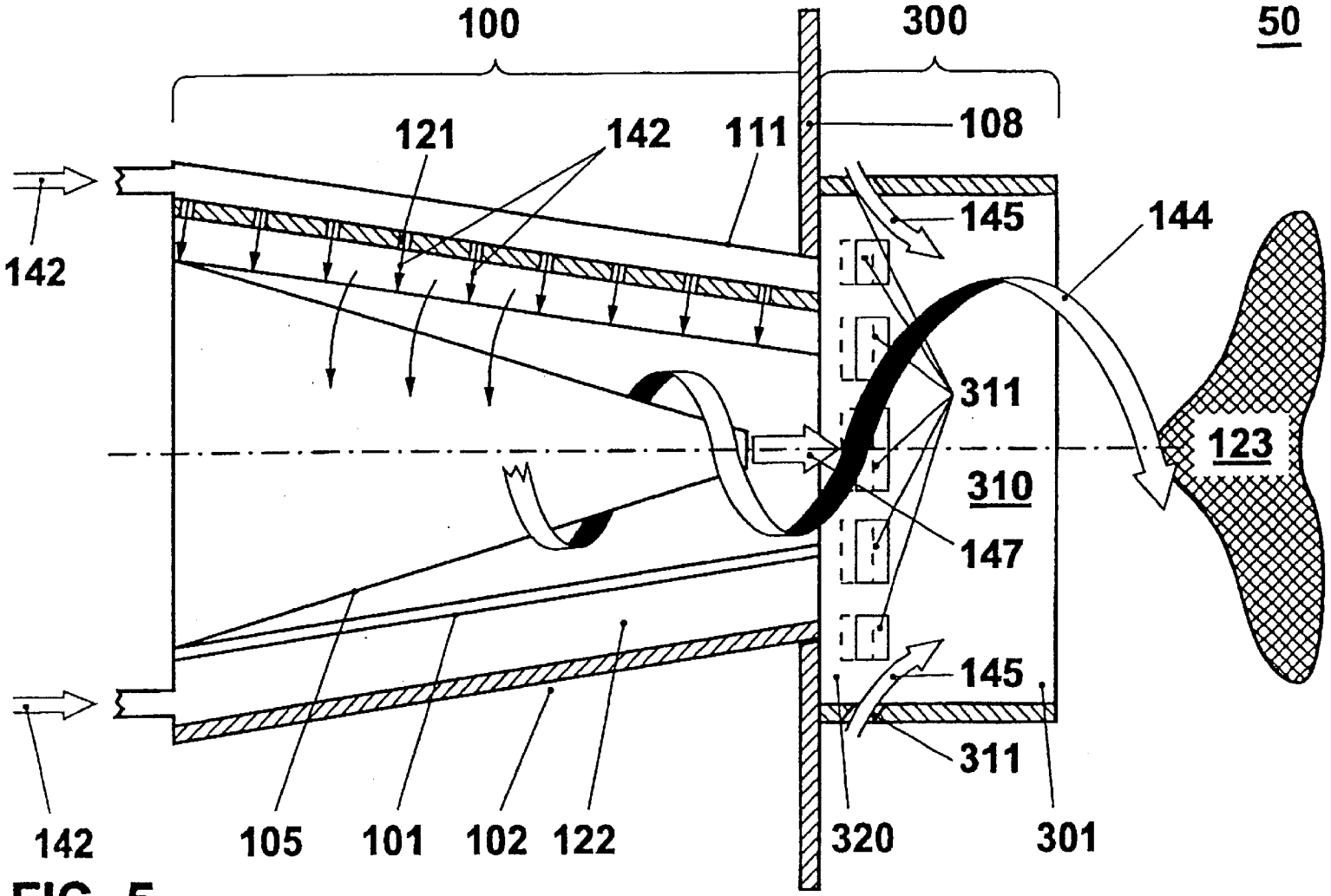
FIG. 5 is a cross sectional view of the burner of the present invention.

An embodiment of the invention with such a swirl producer is shown in FIG. 5. The manner of functioning of the swirl producer 100 is sufficiently well known and is explained in principle in connection with FIG. 3. Deviating from the embodiment of a premix burner shown in FIGS. 3 and 4, the embodiment of a swirl producer 100 shown in FIG. 5 certainly has a conical compression member 105 with a cylindrical or slightly conical housing jacket 102, tapering toward the burner mouth in the combustion chamber 50. Combustion air flows with a strong tangential speed component into the swirl producer interior 122 through tangential inlet slots 121 which extend parallel to the longitudinal axis. Fuel, which mixes as homogeneously as possible with the combustion air in the interior (122) of the swirl producer, is metered into the combustion air through inlet apertures 142. The injection device (112) for the axial central flow (147) is appropriately arranged in the region of the downstream end of this compression body. The downstream end of the swirl producer (100) borders on a front plate (108), which preferably forms the end wall of the combustion chamber (50). The interior (122) has the cross section widening in the flow direction which is characteristic of this category of burner. The swirl flow (144) which forms as a result of the tangential inflow of the combustion air has an axial component of motion toward the mouth of the swirl producer in the combustion chamber (50). The combustion gas mixing section (300) projecting into the combustion chamber (50) adjoins the swirl producer (100) downstream, with the formation of a sudden cross section widening, [from the] interior (122) of the swirl producer (100) to the interior (322) of the mixing section (300). Analogously to the mechanisms of action explained in connection with FIG. 1 and FIG. 6, combustion gases (145) are sucked out of the combustion chamber (50) through the combustion gas passage channels (311) and are homogeneously distributed in the swirled fuel/air mixture (144) with the formation of a mixture temperature. To avoid repetition, reference is made to the statements there.

Figure 6:
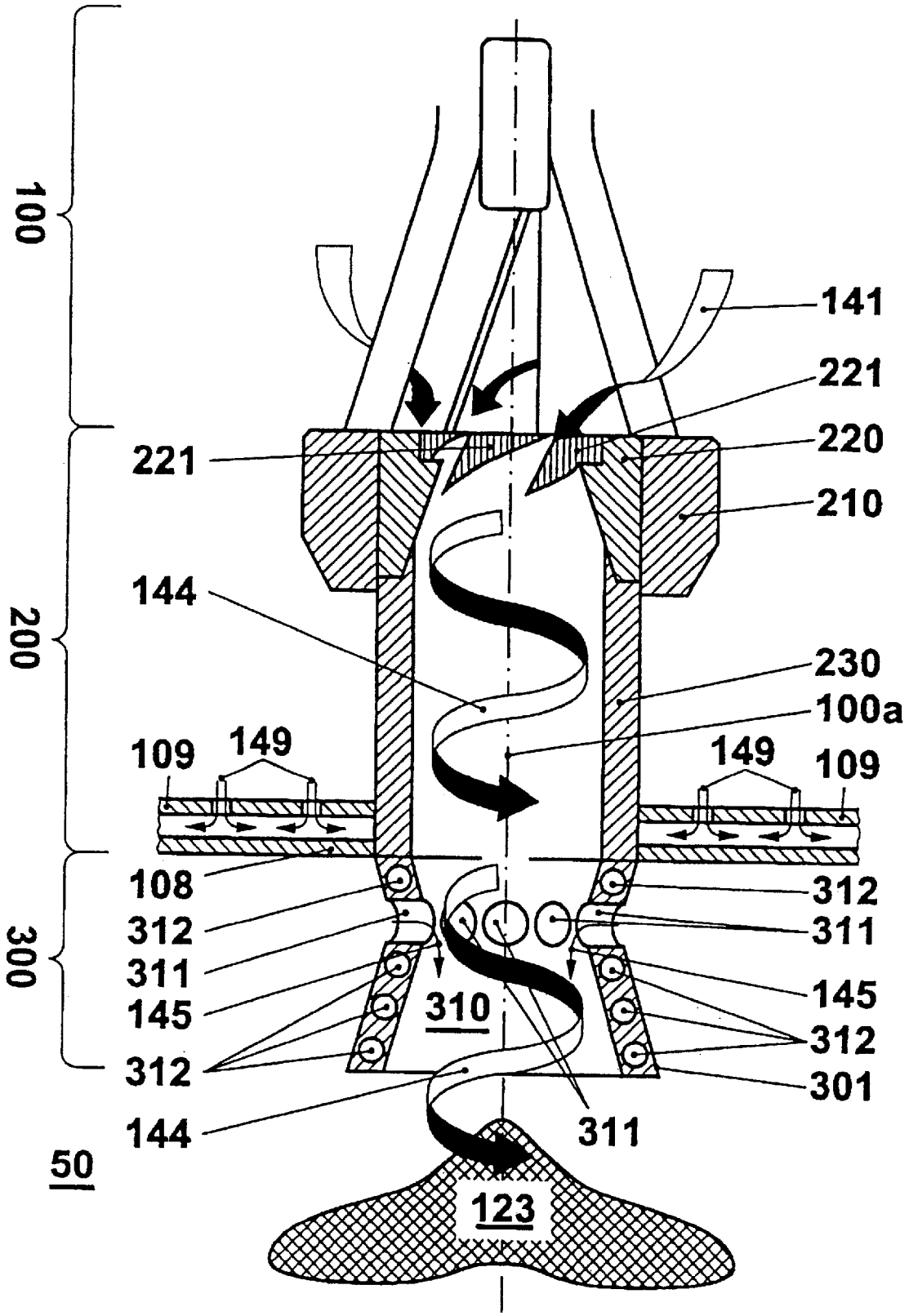
FIG. 6 is a cross sectional view of th burner of the present invention.

It is known from EP 0 780 629, which document is incorporated herein by reference, to arrange a fresh gas mixing tube 230 downstream of the swirl producer of a burner characterized in the preamble, to intensify the mixing of fuel and combustion air. The implementation of the invention with such a burner is shown in FIG. 6 by way of example. Downstream of a conical swirl producer 100, whose construction and function are not further discussed in detail at this point, a first mixing section 200 is arranged, serving as a fresh gas mixing section. The swirl producer (100) is secured to a holder ring 210. A transition element 220 is furthermore arranged in the holder ring 210, and is provided with a number of transition channels 221 which transfer the swirl flow 144 generated from the inflowing combustion air in the swirl producer 100 into the first mixing section, without sudden changes of cross section. The fresh gas mixing tube proper 230 is arranged downstream of the transition element 220. If necessary, a further homogenization of the mixture of combustion air and fuel takes place in this first mixing tube 230. A front segment 108 forming a combustion space wall is in this example impact cooled by impact cooling air 149 and cooling baffles 109. Downstream of the fresh gas mixing section 200, a flue gas mixing section 300 is arranged according to the invention. The throughflow cross section of the interior of the mixing section 200 takes a constant convergent-divergent course, in that the throughflow cross section first narrows to a minimum value and then continuously increases again to the mouth of the mixing section 300. A number of throughflow channels 311, preferably of circular shape, are arranged distributed over the periphery of the wall 301 in the region of the narrowest flow cross section. In operation, the accelerating swirl flow 144, because of the injector-like configuration of the flow cross section, sucks flue gas 145 out of the combustion chamber 50 into the mixing section interior 310. In the further course of the mixing section 300, the entering combustion gases and the fuel/air mixture are mixed to a homogeneous mixture. As already mentioned, the temperature of the mixture is significantly raised, and as a result the flame stability is clearly improved. The mixing section 300 is subjected to a high thermal stress because of its exposed position in the combustion chamber 50. Cooling of the housing jacket is therefore to be provided for when conventional materials are used. The housing is provided for this purpose with coolant channels 312 through which cooling air flows. In the interest of efficient cooling, the cooling air can be let out into the combustion chamber 50 via film cooling bores after passing through the coolant channels 312.

The burner can also be provided with a cylindrical or conically slightly tapering swirl producer (100) with a mixing section (200) following downstream of the swirl producer (100), without departing from the scope of the invention.

Figure 9:
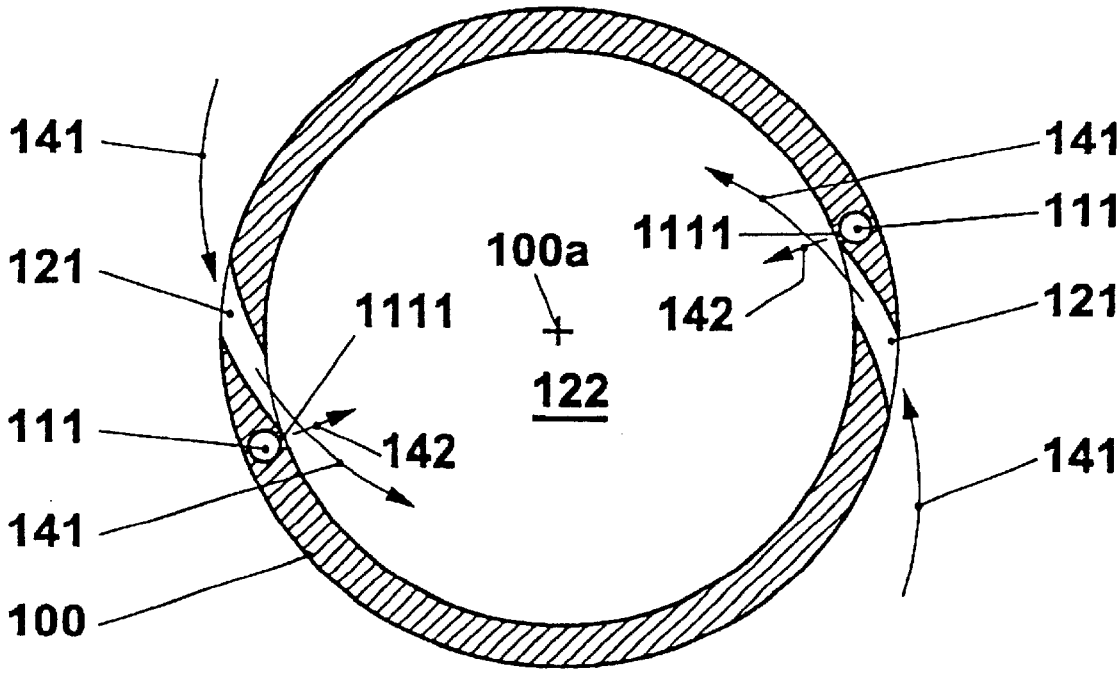
FIG. 9 is a cross sectional view of a swirl producer with a hollow cylindrical monolith.
Figure 10:
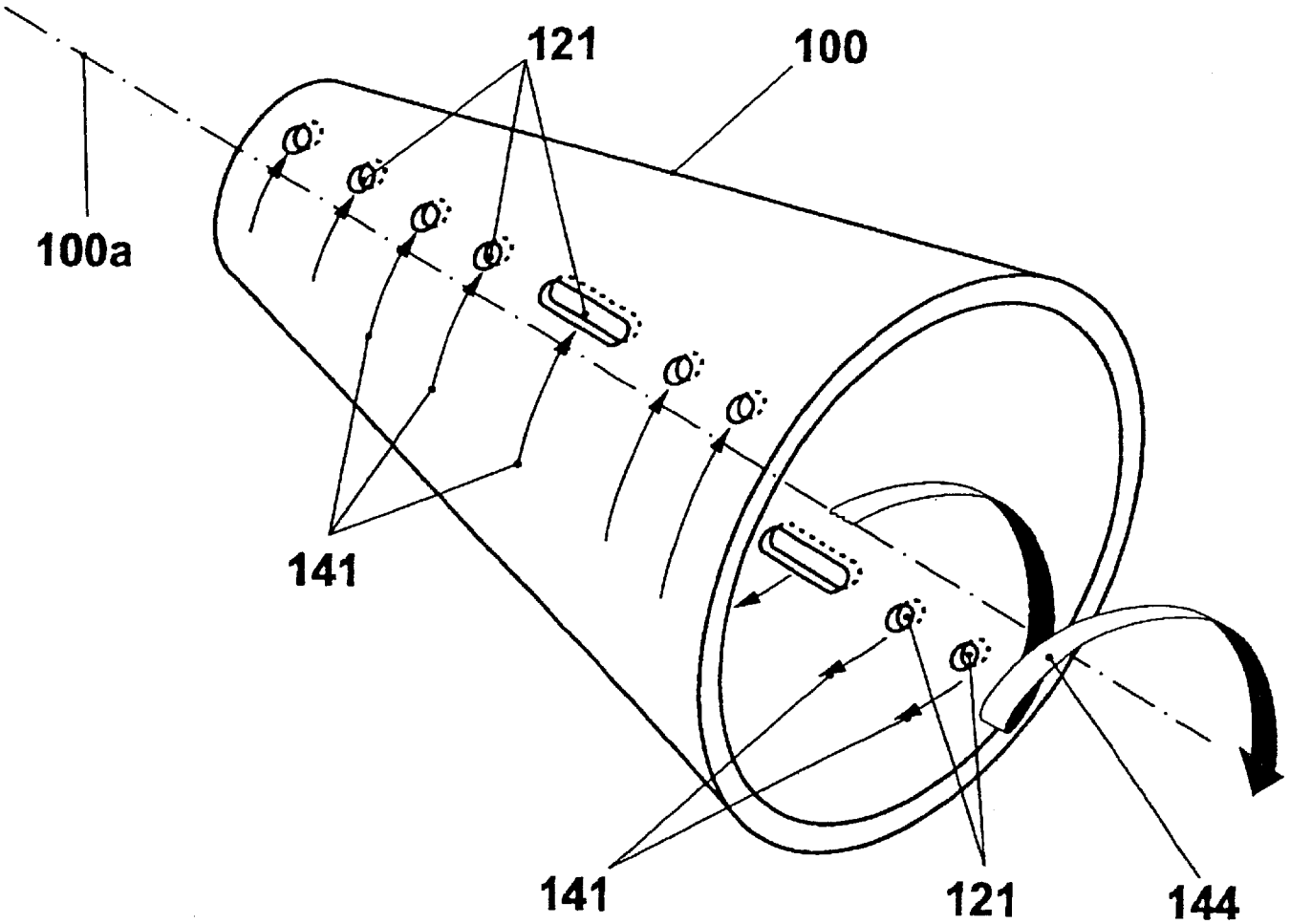
FIG. 10 is a perspective view of the burner according to the present invention.

Swirl producers with tangential combustion air inlets can be constructed in different ways. Besides the construction shown in cross section in FIGS. 7 and 8 with several partial members (101, 102, 103, 104), monolithic modes of construction with inlet apertures are possible. Such an embodiment is shown in cross section in FIG. 9. The swirl producer (100) is constructed of a hollow cylindrical monolith. Machined in to this are inlet apertures (121) in the form of slots running axially and tangentially, through which a combustion air flow 141 flows in tangentially into the interior 122 of the swirl producer (100). Furthermore, fuel feeds 111 in the form of bores running axially arranged in the region of the inlet apertures can be seen, and have outlet bores 1111 through which an amount of fuel 142 can flow out into the combustion air flow 141. A conical swirl producer 100 of a monolithic hollow body is shown in FIG. 10. This could of course also be cylindrical. Tangential openings, for example, bores, are machined into the monolithic swirl producer and likewise serve as tangential inlet apertures 121 for a combustion air flow 141.

The embodiment examples shown above are in no case to be understood in a limitative sense for the invention. On the contrary, they are to be understood as instructive and as an outline of the multiplicity of the possible embodiments within the scope of the invention characterized in the claims.

Preferred processes for the operation of a burner according to the invention will be apparent to the person skilled in the art from the specific application.

Figure 11:
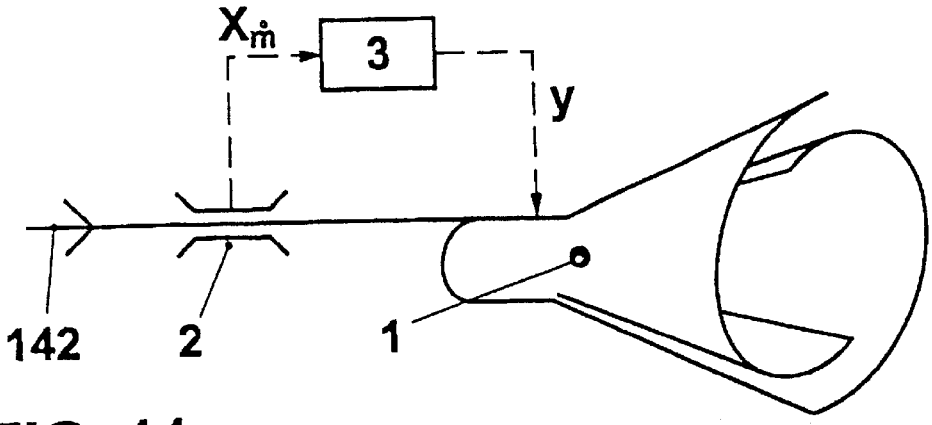
FIG. 11 is a schematic of the burner showing a first made of operation.

A first mode of operation, which is simple to manipulate, is shown in FIG. 11. The burner 1 is operated with an amount of fuel 142. The mass flow of this fuel is determined at a measurement point 2. The resulting mass flow signal $X_m$ is processed in a control unit 3, and is converted into a control signal Y for the adjusting mechanism of the axial central air injection of the burner 1.

Figure 12:
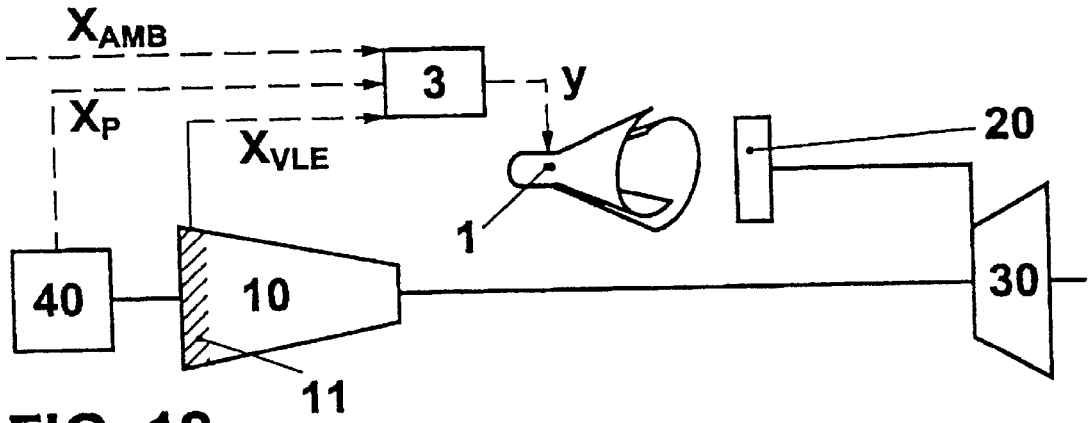
FIG. 12 is a schematic of the burner showing a second mode of operation in a gas turbine plant.
Figure 13:
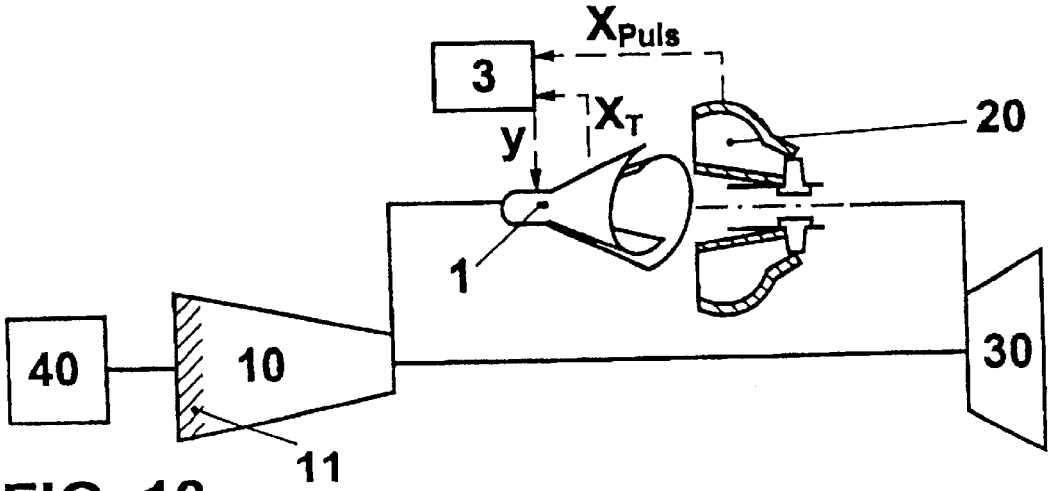
FIG. 13 is a schematic of the burner showing another mode of operation in a gas turbine plant.

A second embodiment, shown in FIG. 12, concerns the use of the burner according to the invention in gas turbine plants, for which the burner according to the invention is particularly suitable. In the example of FIG. 13, a compressor 10, a turbine 30, and a generator 40 are arranged on a common shaft. The compressor 10 is equipped with an adjustable forward guide row 11. A combustion chamber 20 is arranged between the compressor 10 and the turbine 30, in the flow path of a working medium. The combustion chamber 20 is operated with at least one burner 1 according to the invention. A control signal Y is conducted from a control unit 3 to the adjustable device for injecting the axial central flow. In the example shown, the control unit 3 receives a power signal $X_p$, signals $X_{AMB}$ from sensors (not shown) which determine environ-mental conditions such as temperature, humidity and pressure of the ambient air, and also a signal $X_{VLE}$, which reports the setting of the forward guide row 11. A whole series of data relative to machine operation can of course be supplied to the control unit 3; in particular, the generator power signal could be replaced by fuel mass flow signals. The control unit 3 is able to form from these magnitudes a combustion air specific burner loading, and to determine from this the control signal Y for the adjusting mechanism of the burner 1.

A gas turbine set with a compressor 10, a turbine 30, and a generator 40 arranged on a common shaft is again shown in FIG. 13. The combustion chamber 20 is shown as an annular combustion chamber, in longitudinal section, and is operated with at least one burner 1 according to the invention. The burner 1 is provided with a temperature measurement point for the determination of the material temperature, and produces a temperature signal $X_T$. The combustion chamber 20 is provided with a pulsation measurement device for the determination of combustion pressure fluctuations, and producing a pulsation signal $X_{puls}$. The signals $X_T$ and $X_{puls}$ are conducted to a control unit 3, which generates a control signal Y for control of the intensity of the axial central flow. If the material temperature exceeds a given threshold value, the centrally injected mass flow is increased, so as to drive the flame a little away from the burner mouth, reducing the heat loading of the burner. On the other hand, an undesired reduction of the flame stability can result from this. This is determined by the pulsation measurement point. When the pulsation signal $X_{puls}$ increases, the centrally injected mass flow can be decreased, in order to increase the combustion stability and to counteract the increase in combustion pressure fluctuations. The central injection can be regulated in this manner, depending on the measured relevant data.

It goes without saying that the operating process described can also form a portion of substantially more complex, superordinated control designs, and can be integrated into these.

The foregoing explanations serve the person skilled in the art as illustrative examples for the many possible embodiments of the burner according to the invention and characterized in the claims, and for their advantageous modes of operation. They are not to be understood as limitative.

List of reference numerals

1 burner
2 mass flow measurement point
3 control unit
10 compressor
11 adjustable forward guide row
20 gas turbine combustion chamber
30 turbine
40 generator
50 combustion chamber
100 swirl producer
100*a* longitudinal axis of the swirl producer, burner
102, 102, 103, 104 swirl producer partial members
101*a*, 102*a*, 103*a*, 104*a* axes of swirl producer partial members
105 swirl producer interior member
108 front plate, front segment
109 cooling baffle
111 fuel duct
112 injection device
113 central fuel nozzle
121 tangential inlet slots
122 internal space of the swirl producer
123 backflow zone
141 combustion air flow
142 amount of fuel
144 swirl flow
145 combustion gases
146 central fuel amount to be injected
147 central injected fuel
148 cooling air
149 impact cooling air
150 air quantity, wall film
200 mixing section
210 holding ring
220 transition element
221 transition channel
230 mixing tube
231 wall film bores
232 outline edge
300 mixing section
301 jacket housing of the mixing section
311 passage channels for combustion gases
320 eddy
322 interior of the mixing section (300)
1051 chamber
1081 film cooling apertures
1111 outlet bore
1121 throughflow members
1122 central member
1123 cone
1124 bore
1125 aperture
1126 outer member
1127 outer control bore
1128 inner control bore
1131 fuel supply
X measurement quantities
Y setting quantities

What is claimed is:

1. Burner with high flame stability for use in a heat producer, substantially consisting of a swirl producer with means for the tangential introduction of a combustion air flow into an interior of the swirl producer, and also means for the introduction of at least one fuel into the combustion air stream with the formation of a swirl flow with an axial component of motion toward the burner mouth, wherein a mixing section projecting at least partially into the combustion chamber is arranged downstream of the swirl producer, and this mixing section has, in an upstream region, passage channels to the combustion chamber.

2. Burner according to claim 1, wherein it has a sudden cross section widening in the transition region from the swirl producer to the mixing section, the passage channels to the combustion chamber being arranged immediately downstream of this cross section widening.

3. Burner according to claim 2, wherein the cross sectional surface ratio of the mixing section to the swirl producer is 1.05 to 2.5.

4. Burner according to claim 2, wherein the mixing section has a substantially cylindrical inner contour.

5. Burner according to claim 1, wherein the mixing section has a convergent-diver-gent inner contour in the axial direction, and the passage channels to the combustion chamber are arranged in the region of the narrowest cross section.

6. Burner according to claim 5, wherein the diffusor half angle of the mixing section is 3° to 10°.

7. Burner according to claim 2, wherein the passage channels are arranged uniformly over the periphery of the jacket housing sur-rounding the mixing section.

8. Burner according to claim 2, wherein the connecting channels have a substantially circular or oval cross-sectional shape.

9. Burner according to claim 2, wherein the passage channels have a substantially rectangular cross-sectional shape.

10. Burner according to claim 9, wherein the passage channels are of annular gap shape constitution.

11. Burner according to claim 2, wherein the passage channels have a constant cross section in the flow direction.

12. Burner according to claim 2, wherein the longitudinal axes of the passage channels run perpendicularly to the burner axis.

13. Burner according to claim 2, wherein the longitudinal axes of the passage channels run at an acute angle to the burner axis.

14. Burner according to claim 1, wherein the jacket housing enveloping the mixing section is mechanically coupled to the housing of the swirl producer.

15. Burner according to claim 1, wherein the jacket housing enveloping the mixing section is mechanically decoupled from the housing of the swirl producer.

16. Burner according to claim 1, wherein the jacket housing enveloping the mixing section consists of a metallic material.

17. Burner according to claim 16, wherein the jacket housing is cooled.

18. Burner according to claim 1, wherein the jacket housing enveloping the mixing section consists of a ceramic material.

19. Burner according to claim 1, for operation in a combustion chamber of a gas turbine plant.

* * * * *

UNITED STATES PATENT AND TRADEMARK OFFICE

CERTIFICATE OF CORRECTION

PATENT NO. : 6,640,545 B2 
DATED : November 4, 2003
INVENTOR(S) : Thomas Ruck and Hans Peter Knoepfel It is certified that error appears in the above-identified patent and that said Letters Patent is hereby corrected as shown below:

Title page,
Insert Item:
-- [73] Assignee: Alstom (Switzerland) Ltd, Baden (CH) --

Signed and Sealed this

Twelfth Day of October, 2004

JON W. DUDAS
*Director of the United States Patent and Trademark Office*